US008735788B2

(12) United States Patent
Preston et al.

(10) Patent No.: US 8,735,788 B2
(45) Date of Patent: May 27, 2014

(54) PROPULSION AND MANEUVERING SYSTEM WITH AXIAL THRUSTERS AND METHOD FOR AXIAL DIVERT ATTITUDE AND CONTROL

(75) Inventors: Kenneth G. Preston, Sahuarita, AZ (US); Michael A. Leal, Tucson, AZ (US); Rondell J. Wilson, Vail, AZ (US); Richard C. Hussey, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 275 days.

(21) Appl. No.: 13/030,307

(22) Filed: Feb. 18, 2011

(65) Prior Publication Data

US 2012/0211596 A1 Aug. 23, 2012

(51) Int. Cl.

| | |
|---|---|
| ***F42B 15/01*** | (2006.01) |
| ***F41G 7/22*** | (2006.01) |
| ***F42B 10/60*** | (2006.01) |
| *F42B 15/00* | (2006.01) |
| *F41G 7/00* | (2006.01) |
| *F42B 10/00* | (2006.01) |

(52) U.S. Cl.
USPC ..... 244/3.22; 244/3.1; 244/3.15; 244/3.16; 244/3.19; 244/3.21

(58) Field of Classification Search
USPC ..... 244/3.1–3.3, 158.1, 164, 165, 168, 169, 244/171, 172.2, 172.3; 60/200.1, 204, 205, 60/207, 253; 701/1, 3, 4, 13, 400, 531; 417/321, 375, 379
See application file for complete search history.

(56) References Cited

U.S. PATENT DOCUMENTS

| | | | | | |
|---|---|---|---|---|---|
| 3,231,223 | A | * | 1/1966 | Upper | 244/169 |
| 3,347,494 | A | * | 10/1967 | Wright | 244/3.22 |
| 3,624,367 | A | * | 11/1971 | Hamilton et al. | 244/3.2 |
| 3,732,693 | A | * | 5/1973 | Chu | 60/207 |
| 3,862,732 | A | * | 1/1975 | Wyatt et al. | 244/165 |
| 3,977,633 | A | * | 8/1976 | Keigler et al. | 244/169 |
| 4,085,909 | A | * | 4/1978 | East et al. | 244/3.21 |
| 4,408,735 | A | * | 10/1983 | Metz | 244/3.22 |
| 4,413,795 | A | * | 11/1983 | Ryan | 244/3.22 |
| 4,463,921 | A | * | 8/1984 | Metz | 244/3.22 |
| 4,482,107 | A | * | 11/1984 | Metz | 244/3.22 |
| 4,542,870 | A | | 9/1985 | Howell | |
| 4,550,888 | A | * | 11/1985 | Douglass et al. | 244/3.22 |
| 4,609,169 | A | * | 9/1986 | Schweickert et al. | 244/169 |
| 4,659,036 | A | * | 4/1987 | Pinson | 244/3.22 |

(Continued)

OTHER PUBLICATIONS

"International Application Serial No. PCT/US2011/064935, International Search Report mailed Apr. 17, 2012", 2 pgs.

(Continued)

*Primary Examiner* — Bernarr Gregory
(74) *Attorney, Agent, or Firm* — Schwegman, Lundberg & Woessner, P.A.

(57) ABSTRACT

Embodiments of a propulsion and maneuvering system that may be suitable for use during a terminal phase in an interceptor are generally described herein. The propulsion and maneuvering system may include one or more axial thrusters to provide thrust along axial thrust lines that run through a center-of-gravity of the interceptor and a plurality of divert thrusters to provide thrust in radial directions. The combination of divert and axial thrusters may allow the interceptor to respond to a maneuvering target and may allow the interceptor to increase its velocity along a line-of-sight (LOS) to a target to change target impact/engagement time.

22 Claims, 4 Drawing Sheets

(56) References Cited

U.S. PATENT DOCUMENTS

| | | | | | |
|---|---|---|---|---|---|
| 4,684,080 | A | * | 8/1987 | Pinson | 244/3.22 |
| 4,856,734 | A | * | 8/1989 | Davies | 244/3.22 |
| 4,955,558 | A | * | 9/1990 | Machell et al. | 244/3.22 |
| 4,967,982 | A | | 11/1990 | Bagley | |
| 5,026,259 | A | * | 6/1991 | Whitehead et al. | 417/379 |
| 5,054,712 | A | * | 10/1991 | Bar et al. | 244/3.22 |
| 5,061,930 | A | * | 10/1991 | Nathanson et al. | 244/3.19 |
| 5,062,593 | A | * | 11/1991 | Goddard et al. | 244/169 |
| 5,140,525 | A | * | 8/1992 | Shankar et al. | 244/164 |
| 5,141,181 | A | * | 8/1992 | Leonard | 244/172.2 |
| 5,238,204 | A | * | 8/1993 | Metz | 244/3.15 |
| 5,417,049 | A | * | 5/1995 | Sackheim et al. | 244/169 |
| 5,456,425 | A | * | 10/1995 | Morris et al. | 244/3.22 |
| 5,533,331 | A | | 7/1996 | Campbell et al. | |
| 5,850,992 | A | * | 12/1998 | Flament et al. | 244/168 |
| 6,135,393 | A | * | 10/2000 | Sackheim et al. | 244/169 |
| 6,231,003 | B1 | * | 5/2001 | Hibma et al. | 244/3.22 |
| 6,267,326 | B1 | * | 7/2001 | Smith et al. | 244/3.22 |
| 7,026,980 | B1 | | 4/2006 | Mavroudakis et al. | |
| 7,281,367 | B2 | * | 10/2007 | Rohrbaugh et al. | 60/253 |
| 7,416,154 | B2 | * | 8/2008 | Bittle et al. | 244/3.22 |
| 7,580,778 | B2 | * | 8/2009 | Krishnaswamy et al. | 244/164 |
| 7,716,912 | B2 | | 5/2010 | Cover et al. | |
| 7,741,588 | B2 | * | 6/2010 | Gundel et al. | 244/3.15 |
| 7,891,298 | B2 | * | 2/2011 | Minick et al. | 244/3.22 |
| 8,084,726 | B2 | * | 12/2011 | Hanlon et al. | 244/3.22 |

OTHER PUBLICATIONS

"International Application Serial No. PCT/US2011/064935, Written Opinion mailed Apr. 17, 2012", 6 pgs.

"International Application Serial No. PCT/US2011/064935, International Preliminary Report on Patentability mailed Aug. 29, 2013", 8 pgs.

* cited by examiner

PROPULSION AND MANEUVERING SYSTEM WITH AXIAL THRUSTERS AND METHOD FOR AXIAL DIVERT ATTITUDE AND CONTROL

GOVERNMENT RIGHTS

This invention was not made with United States Government support. The United States Government does not have certain rights in this invention.

TECHNICAL FIELD

Embodiments pertain to interceptors. Some embodiments relate to propulsion and maneuvering systems that may be suitable for interceptors. Some embodiments relate to propulsion and maneuvering systems that may be suitable for use during the terminal phase of flight of interceptors. Some embodiments relate to exo-atmospheric missile interception. Some embodiments relate to ballistic missile defense systems.

BACKGROUND

The spread of ballistic missile technology has accelerated in recent years. This proliferation has been difficult to control and more countries have developed sophisticated missile designs, including missiles capable of reaching great distances. Great danger also lies in the existence of chemical, biological, and nuclear weapons that can be paired with ballistic missiles. Ballistic missile defense is one of the most challenging missions because a ballistic missile's altitude, speed, and range leave a defender little room for error. To meet this challenge, a system capable of destroying a ballistic missile requires accurate missile identification and tracking with advanced sensors, advanced interceptor missiles or directed energy weapons (e.g. lasers), and quick reaction time provided by reliable command and control, battle management, and communications.

In a ballistic missile defense scenario where closing velocities are immense, multiple stage interceptors may be used to engage threats. The operation of the final stage may determine the success of a mission. Missile systems, which employ boost-coast sustainer phases, use different control schemes for the various phases of trajectory. A control scheme with multiple sources of control effectiveness may be more beneficial during the operation of an interceptor in the homing phase where the precise control in a dynamic environment is needed.

Thus, what is needed are propulsion and maneuvering systems and methods suitable for use to control and guide the interceptor to interception/impact of the threat. What is needed are propulsion and maneuvering systems and methods suitable for use during the operation of said interceptor which allows the interceptor to respond to a maneuvering target. What is also needed are propulsion and maneuvering systems and methods that provides axial and divert thrust to allow an interceptor to respond to a maneuvering target.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
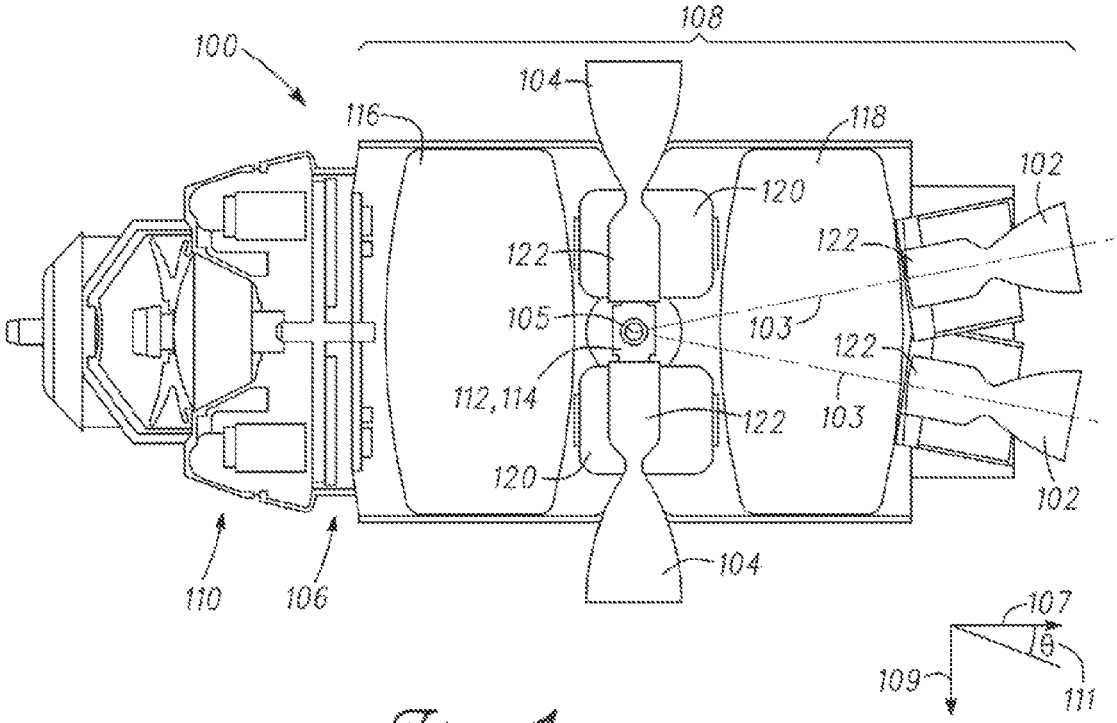
FIG. 1 illustrates an interceptor in accordance with some embodiments.

FIG. 1 illustrates an interceptor in accordance with some embodiments. Interceptor 100 may be suitable for use during the terminal (homing) phase of flight before intercept. In accordance with embodiments, the interceptor 100 may include one or more axial thrusters 102 and a plurality of divert thrusters 104. The one or more axial thrusters 102 may provide thrust along axial thrust lines 103 that run through a center-of-gravity (CG) 105 of the interceptor 100. The divert thrusters 104 may provide thrust in radial directions 109. The interceptor 100 may also include a common propellant distribution manifold 114 for distributing pressurized gas or fuel to both the axial thrusters 102 and the divert thrusters 104. The axial thrusters 102, the divert thrusters 104 and the common propellant distribution manifold 114 may be part of propulsion and maneuvering system 108. Since the propulsion and maneuvering system 108 provides axial and divert thrust, the interceptor 100 may be able to better respond to a maneuvering target during the terminal phase of flight. These embodiments are discussed in more detail below.

In these embodiments, the combined use of both the axial thrusters 102 and the divert thrusters 104 may provide for a significant increase in maneuverability of the interceptor 100 allowing it to respond to maneuvering of a target. The use of axial thrust, in combination of lateral thrust, may increase the interceptor's velocity at burn out ($V_{bo}$), increase range and or altitude of the interceptor, provide pursuit capability and provide for enhanced acceleration. As discussed in more detail below, the combination of the divert thrusters 104 and the axial thrusters 102 may allow the interceptor 100 to respond to a maneuvering target and may allow the interceptor to increase its velocity along a line-of-sight (LOS) to a target to change target impact/engagement time.

As illustrated in FIG. 1, the axial thrusters 102 may provide axial thrust along axial thrust lines 103, which may run generally in the axial direction 107 and through the CG 105 of the interceptor 100. The radial directions 109 may be perpendicular to the axial direction 107. The divert thrusters 104 may be referred to as lateral or radial thrusters. The common propellant distribution manifold 114 may distribute pressurized gas or fuel prior to mixing and combustion in combustion chambers 122.

In some embodiments, the propulsion and maneuvering system 108 includes two or more axial thrusters 102. In these embodiments, each of the axial thrusters 102 may be canted at an angle 111 with respect to the axial direction 107. In these embodiments with at least two axial thrusters 102, the thrust provided along the axial thrust lines 103 is at the angle 111 with respect to the axial direction 107 and provided through the CG 105. When there are two or more axial thrusters 102, the angle 111 may be a fixed angle that ranges from between ten and thirty degrees, although the scope of the embodiments is not limited in this respect. In some embodiments that include a single axial thruster 102, the angle 111 may be zero degrees with respect to the axial direction 107.

As illustrated in FIG. 1, the interceptor 100 may also include a seeker 110 for use in tracking a maintaining a line-of-sight (LOS) with a target. By providing thrust along the axial thrust lines 103, the seeker 110 may maintain the LOS with the target as the axial thrusters 102 are engaged. The use of axial thrust provided by the axial thrusters 102 may allow the interceptor to change the engagement time with the target by changing the velocity in the LOS ($V_{LOS}$) direction in response to maneuvering of the target. This is unlike many conventional interceptors which are unable to track a target while providing thrust in the LOS direction. Because conventional interceptors do not have axial thrusters, a conventional interceptor may be required to rotate up to ninety-degrees and use a radial thruster to provide thrust to change its $V_{LOS}$.

In accordance with embodiments, the divert thrusters 104 are generally used for guidance correction (i.e., change the course, correct guidance error, maneuvering) of the interceptor 100, while the axial thrusters 102 can be used to increase velocity in the LOS direction as well as increase the burn-out velocity ($V_{bo}$) of the interceptor 100.

In embodiments in which the propulsion and maneuvering system 108 includes two axial thrusters 102 provided at an aft-end of the interceptor 100 and four of the divert thrusters 104 provided at ninety-degree radial positions on the interceptor, the net sum of the axial thrusters 102 may be configured to provide at least twice an amount of thrust of any of the lateral thrusters 104. In some embodiments, each of the axial thrusters 102 may provide thrust between 300 and 600 pounds of force, although the scope of the embodiments is not limited in this respect.

In accordance with some embodiments, the propulsion and maneuvering system 108 may also include a propulsion system controller 106 and a set of control valves 112 to control a release of the pressurized gas or fuel from the common propellant distribution manifold 114 in response to control signals from the propulsion system controller 106. The propulsion system controller 106 may configure the valves 112 regulate the release of the pressurized gas or fuel between the axial thrusters 102 and the divert thrusters 104 to allow varying amounts of thrust to be provided axially and laterally.

In these embodiments, the valves 112 may regulate the release of the pressurized gas or fuel between the axial thrusters 102 and the divert thrusters 104 allowing different amounts of thrust to be provided axially or laterally. In some embodiments, the valves 112 may be on/off valves that may be controlled with a pulse-width modulated (PWM) signal to regulate the release of the pressurized gas from the common propellant distribution manifold 114. In some embodiments, a control valve 112 may be provided for each of the axial thrusters 102 and each of the divert thrusters 104 allowing the propulsion system controller 106 to maneuver the interceptor 100 as described herein.

The embodiments disclosed herein are equally applicable to interceptors that use both liquid fuel propellants (e.g., gas) and solid fuel propellants. In liquid-fueled embodiments, the propulsion and maneuvering system 108 may comprise a liquid fuel tank 116, an oxidizer tank 118 and pressurization tanks 120. In some of these liquid-fueled embodiments, either the fuel tank 116 or the oxidizer tank 118 may have a toroidal shape when provided between the divert thrusters 104 and the axial thrusters 102 of the interceptor 100. In the example illustrated in FIG. 1, the oxidizer tank 118 is positioned between the divert thrusters 104 and the axial thrusters 102 and has a toroidal shape. This allows the pressurized gasses from the common propellant distribution manifold 114 to be provided to the combustion chambers 122 of the axial thrusters 102. In other embodiments, tanks of other shapes may be used. In some liquid-fueled embodiments, propulsion and maneuvering system 108 may be a Liquid Axial Divert Attitude and Control (LADAC) system.

In solid-fueled embodiments, the propulsion and maneuvering system 108 may include solid fuel storage elements that allow a solid fuel to be provided to the axial thrusters 102 and the divert thrusters 104 to allow variable amounts of axial and radial thrust.

Embodiments disclosed herein provide for the integration of axial rocket motors to a divert attitude control system suitable for using both liquid and solid propellants. In some embodiments, the seeker 110 may be an infrared (IR) seeker. The interceptor 100 may also include an inertial-measurement unit (IMU) for navigation. In some embodiments, the interceptor 100 may be a kill vehicle (KV), a kinetic kill vehicle (KKV), or a kinetic warhead. The term interceptor may be referred to as the final stage, the terminal stage, the homing stage.

One advantage to the use of liquid propellant is that it may generate more energy that solid propellant for a given weight. The use of the common propellant distribution manifold 114 may utilize fewer components providing an increase in reliability, a reduction in costs, and a reduction in weight. In some embodiments, the interceptor 100 may be able to provide an increased burn-out velocity (up to a third or more increase) over many conventional interceptors. In some embodiments, range during the terminal stage may be increased, pursuit capability may be provided, and acceleration may be enhanced.

Figure 2:
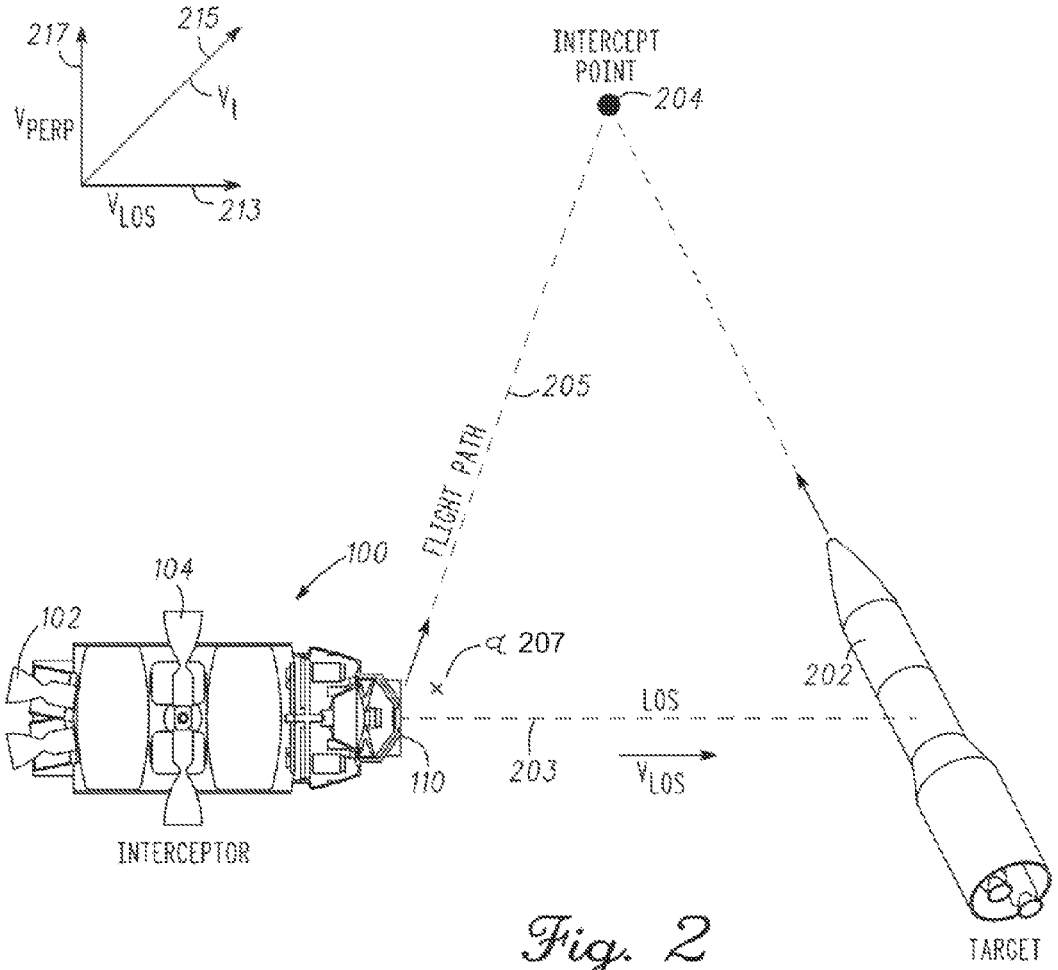
FIG. 2 illustrates an interceptor in the homing phase of flight before intercept in accordance with some embodiments.

FIG. 2 illustrates an interceptor in the homing phase of flight before intercept in accordance with some embodiments. The terminal phase is the last phase of flight before intercept and may be referred to as the homing (end game) phase. During the terminal phase, the interceptor 100 is traveling along flight path 205 to an intercept point 204 while a LOS 203 is maintained with a target 202. It should be noted that during the terminal phase, the seeker 110 of interceptor 100 is looking at the target 202 and may be pointed directly at the target 202 (i.e., along LOS 203) while traveling along the flight path 205 as illustrated in FIG. 2. When operating outside the atmosphere (exo-atmospheric operation), there may be no gimbal operating to allow the seeker 110 to look in other directions (i.e., because there is little or no drag or aero forces). During exo-atmospheric operations, the seeker 110 may be exposed to see the target 202 as illustrated.

As illustrated in FIG. 2, the interceptor 100 may have a total velocity vector ($V_t$) 215 in the direction along the flight path 205. The total velocity vector ($V_t$) 215 may have a component in the LOS 203 direction ($V_{LOS}$) 213 and may have a component perpendicular ($V_{perp}$) 217 to the LOS direction 203. In accordance with embodiments, the interceptor 100 may be configured to maintain the angle 207 ($\alpha$) between the LOS 203 and the flight path 205.

The divert thrusters 104 may be used to change $V_{perp}$ 217 without changing $V_{LOS}$ 213 which allows the interceptor 100 to change the intercept point 204 without changing the impact time. The impact time may be the range to go divided by $V_{LOS}$ 213. The axial thrusters 102 may be used to change the $V_{LOS}$ 213. The combination of the axial thrusters 102 and the divert thrusters 104 may allow the interceptor 100 to change $V_{LOS}$ 213 as well as $V_{perp}$ 217 to add to the total velocity $V_t$ 215, which may be the burn-out velocity ($V_{bo}$). Since both the axial thrusters 102 and the divert thrusters 104 use fuel from the same source, the addition of the axial thrusters 102 provides for advanced terminal phase guidance with little or no additional weight penalty.

In accordance with embodiments, the seeker 110 may be configured to track the target 202 and maintain the LOS 203 with the target 202 as the target 202 maneuvers. The seeker 110 may be further configured to generate command signals for the propulsion system controller 106. Based on control signals from the seeker 110, the propulsion system controller 106 may be configured to recalculate the intercept point 204 with the target 202 and may be configured to control the valves 112 to cause the interceptor 100 to follow a flight path 205 to the recalculated intercept point 204 by selectively deploying a combination of both the axial thrusters 102 and the divert thrusters 104. The Vt 215 may thus be increased without reorienting the interceptor 100.

Accordingly, the seeker 110 is able to track a target 202 while one or a combination of both the axial and lateral thrust is provided. In some embodiments, the propulsion system controller 106 may be responsive to commands from a guidance system 112 of the interceptor 100. In some embodiments, the propulsion system controller 106 may determine when the target 202 is maneuvering based on changes in the angle 207 between the LOS 203 and the flight path 205. The propulsion system controller 106 may be configured to maintain a constant bearing with the target 202 (i.e., by keeping the angle 207 the same) by changing, among other things, the $V_{bo}$ as required, to change the point and/or the time-of-intercept.

In some embodiments, the control valves 112 may include at least one axial thrust control valve coupled to the common propellant distribution manifold 114 and configured for selectively releasing pressurized fuel into combustion chambers 122 of one or more of the axial thrusters 102 for mixing and combustion to provide the axial thrust. The control valves 112 may also include at least one maneuver control valve coupled to the common propellant distribution manifold 114 and configured for selectively releasing pressurized fuel into combustion chambers 122 of one or more of the divert thrusters 104 for mixing and combustion to provide lateral thrust for maneuvering the interceptor 100.

In some embodiments, the propulsion system controller 106 may be configured to control the at least one maneuver control valve and the at least one axial thrust control valve in response to a comparison of a commanded propellant mass flow discharge rate and a calculated actual propellant mass flow discharge rate from the pressure vessel. The propulsion system controller 106 may regulate a valve area of at least one of the at least one axial thrust valve and the at least one maneuver control valve in response to the comparison of a commanded propellant mass flow discharge rate and a calculated actual propellant mass flow discharge rate from the pressure vessel, although the scope of the embodiments is not limited in this respect. The controller 106 may be configured to compute at least one of the commanded propellant mass flow discharge rate and a total valve area to achieve target interception. In some embodiments, the computations may include non-linear computations. The controller 106 may include a burn-rate controller configured to calculate a burn rate from a measured pressure within pressurization tanks 120 and to control the valves 112 to adjust the burn rate in response to a comparison between the measured pressure and an estimated pressure based on the recalculated intercept point.

In some embodiments, differential geometry may be employed by the controller 106 to intercept both maneuvering and non-maneuvering targets. In these embodiments, the added thrust may be provided by both the divert thrusters 104 and the axial thrusters 102 if it is detected that a target is attempting to leave its trajectory path (i.e., maneuvering). The use differential geometry may be used to engage both non-maneuvering and maneuvering targets. The kinematics of the engagement for both maneuvering and non-maneuvering targets may be expressed in differential geometric terms. Two-dimensional geometry may be used to determine the intercept conditions for a straight line target as well as a constant maneuvering target. The intercept conditions for both target types may be developed for the case when the interceptor guides onto a straight line interception. These two cases are shown to have a common set of core conditions such that it enables a unified guidance law to be developed. The guidance law is shown to be globally stable using Lyapunov theory so that guidance capture may be assured for almost any initial condition. The analysis and guidance law design does not rely on local linearization and can be shown to produce guidance trajectories that mirror proportional navigation for the straight line interception of a non-maneuvering target for which proportional navigation was originally developed.

Figure 3A:
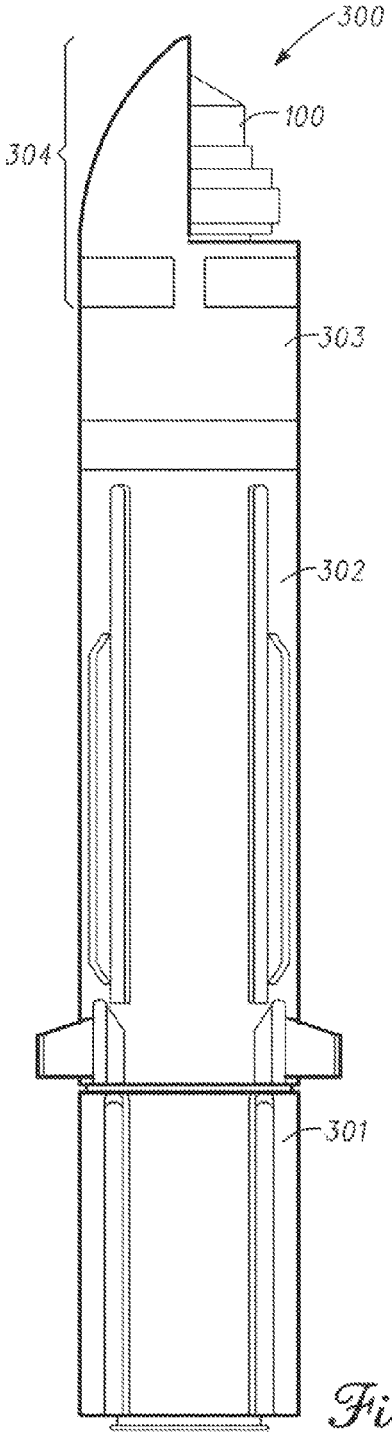
FIG. 3A illustrates a missile system with an interceptor in accordance with some embodiments.

FIG. 3A illustrates a missile system with an interceptor in accordance with some embodiments. Missile system 300 may include a first stage 302, a second stage 302, a third stage 303 and a fourth stage 304. The fourth stage 304 may include an interceptor, such as interceptor 100 (FIG. 1) that may be used during the terminal phase of flight.

Figure 3B:
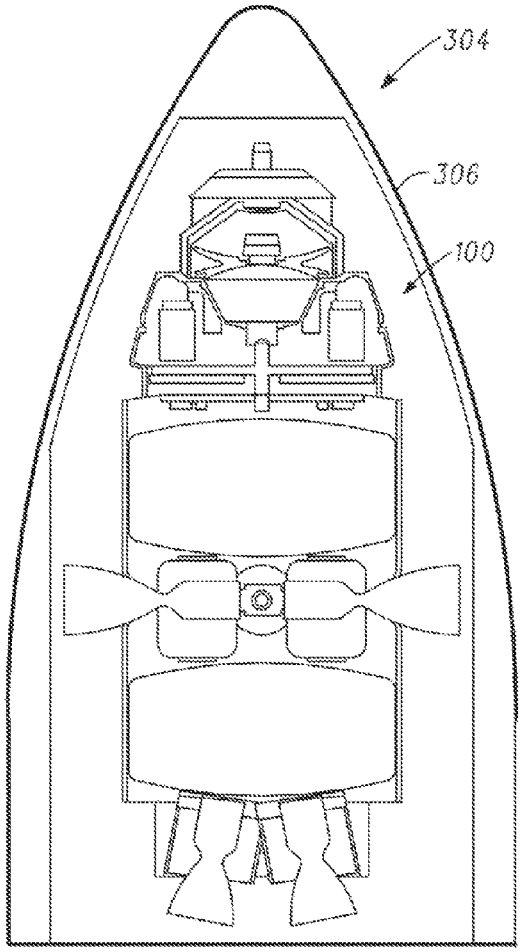
FIG. 3B illustrates an interceptor including an aerodynamic cover in accordance with some embodiments.

FIG. 3B illustrates an interceptor including an aerodynamic cover in accordance with some embodiments. As shown in FIG. 3B, the fourth stage 304 may include an interceptor, such as interceptor 100 (FIG. 1), and aerodynamic cover 306. During the terminal phase, the aerodynamic cover 306 is removed allowing the seeker 110 (FIG. 1) of the interceptor 100 to be exposed for tracking a target during exo-atmospheric operations.

Figure 4:
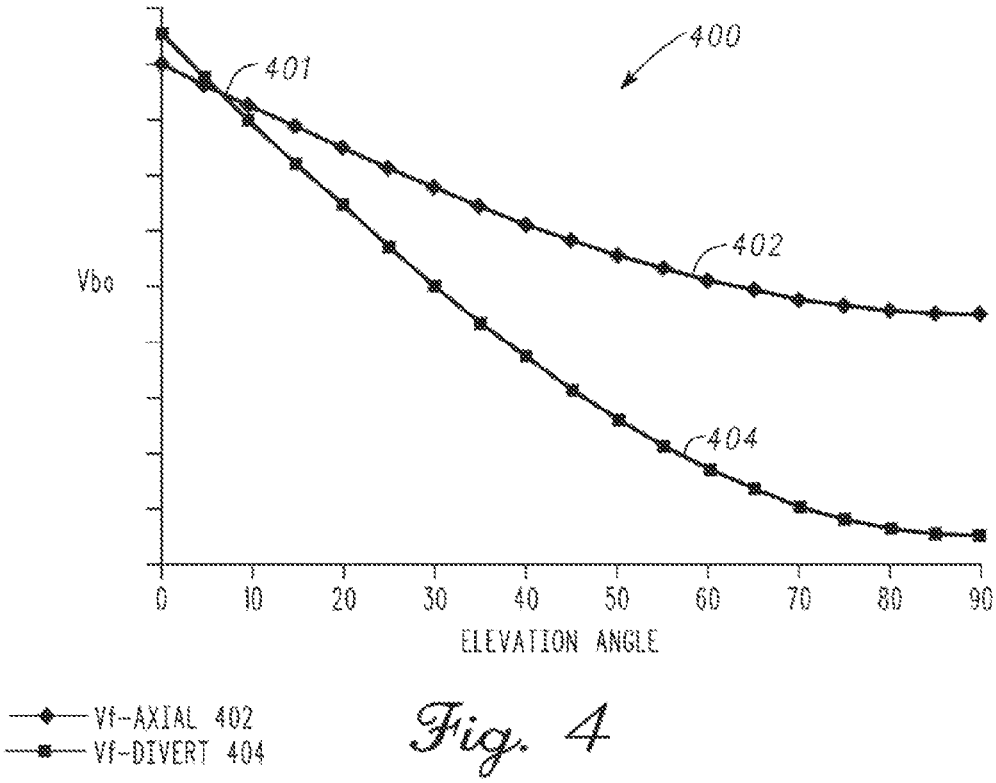
FIG. 4 shows burn-out velocity of a missile vs. elevation angle in accordance with some embodiments.

FIG. 4 shows burn-out velocity ($V_{bo}$) of a missile vs. elevation angle in accordance with some embodiments. The elevation angle may be referenced to a local level plane perpendicular to gravity. The $V_{bo}$ 400 may correspond to the total velocity ($V_t$) of an interceptor, such as interceptor 100 (FIG. 1). Line 402 shows the $V_{bo}$ 400 for the interceptor 100 (FIG. 1) that may be achieved using a combination of axial thrusters 102 and divert thrusters 104 in accordance with embodiments. Line 404 shows the $V_{bo}$ for a more conventional interceptor that may be achieved using only lateral thrusters. As can be seen, a much higher $V_{bo}$ 400 may be achieved with the use of axial thrusters 102, particularly at higher elevation angles beyond crossover point 401.

Figure 5:
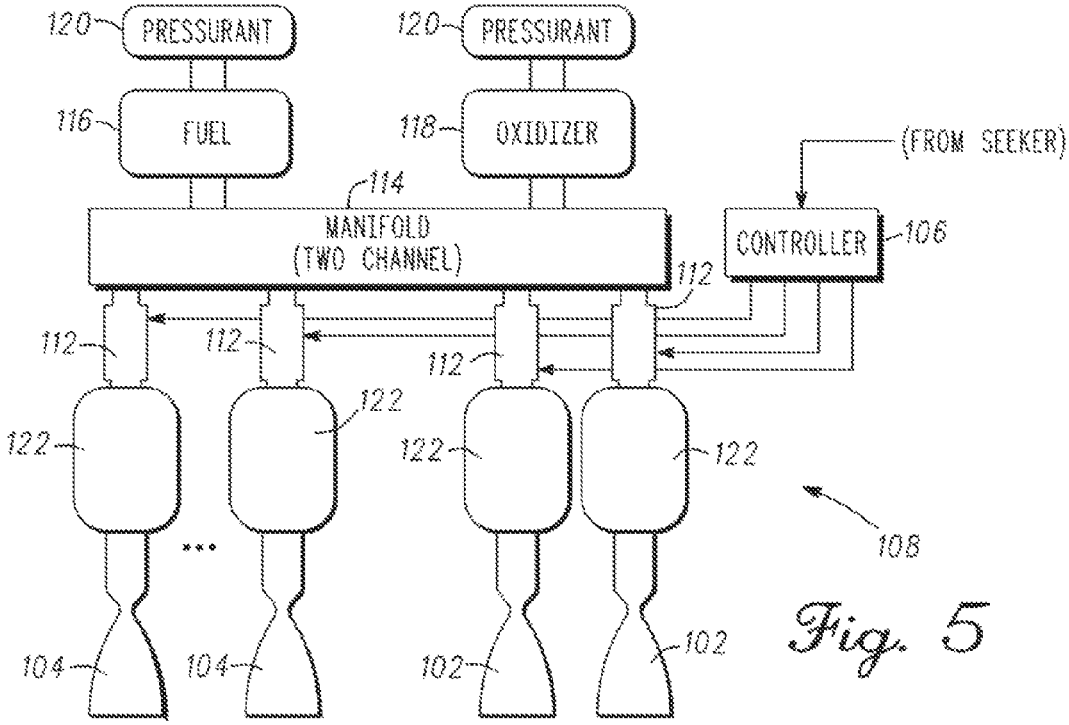
FIG. 5 shows a functional diagram of a propulsion and maneuvering system in accordance with some liquid-fueled embodiments.

FIG. 5 shows a functional diagram of a propulsion and maneuvering system in accordance with some liquid-fueled embodiments. The propulsion and maneuvering system 108 may correspond to the propulsion and maneuvering system 108 illustrated in FIG. 1. The propulsion and maneuvering system 108 may comprise axial thrusters 102 and divert thrusters 104. Each thruster may have a combustion chamber 122. The propulsion and maneuvering system 108 may also comprise a liquid fuel tank 116 and an oxidizer tank 118 coupled to pressurization tanks 120. The liquid fuel tank 116 and the oxidizer tank 118 may also be coupled to the distribution manifold 114. The pressurization tanks 120 may include a pressurant, such as nitrogen, to force the fuel and oxidizer from the liquid fuel tank 116 and the oxidizer tank 118 through the distribution manifold 114 for mixing and burning in combustion chambers 122. One or more valves may couple the pressurization tanks 120 with the liquid fuel tank 116 and the oxidizer tank 118 to control the release of the pressurant. The distribution manifold 114 may be a two-channel distribution manifold to keep the fuel and oxidizer separated until mixing in the combustion chambers 122. In accordance with some embodiments, the propulsion system controller 106 may be configured to control the set of control valves 112 to control the release of the pressurized fuel from the distribution manifold 114 in response to control signals from the propulsion system controller 106.

The propulsion system controller 106 may configure the valves 112 regulate the release of the pressurized fuel between the axial thrusters 102 and one or more of the divert thrusters 104 to allow varying amounts of thrust to be provided axially as well as laterally to effect a change in the $V_{LOS}$ 213 (FIG. 2) as well as to effect a change in the $V_t$ 215 (FIG. 2).

The propulsion system controller 106 may include several separate functional elements that may be implemented by combinations of software-configured elements, such as processing elements including digital signal processors (DSPs), and/or other hardware elements. For example, some elements may comprise one or more microprocessors, DSPs, application specific integrated circuits (ASICs), radio-frequency integrated circuits (RFICs) and combinations of various hardware and logic circuitry for performing at least the functions described herein. In some embodiments, the operations performed by the propulsion system controller 106 may be implemented by one or more processes operating on one or more processing elements.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A propulsion and maneuvering system for use during a terminal phase of an interceptor, the system comprising:

one or more axial thrusters to provide thrust along axial thrust lines that run through a center-of-gravity of the interceptor;

a plurality of divert thrusters to provide thrust in radial directions; and a common propellant distribution manifold for distributing pressurized fuel to both the axial thrusters and the divert thrusters.

2. The propulsion and maneuvering system of claim 1 wherein the propulsion and maneuvering system includes two axial thrusters, and wherein each of the axial thrusters is canted at an angle with respect to an axial direction.

3. The propulsion and maneuvering system of claim 2 wherein providing thrust along the axial thrust lines allows a seeker of the interceptor to maintain a line-of-sight (LOS) with a target as the axial thrusters are engaged.

4. The propulsion and maneuvering system of claim 3 further comprising:

a propulsion system controller; and a set of valves to control a release of the pressurized fuel from the common propellant distribution manifold in response to control signals from the propulsion system controller, wherein the propulsion system controller is to configure the valves regulate the release of the pressurized fuel between the axial thrusters and one or more of the divert thrusters to allow varying amounts of thrust to be provided axially and laterally.

5. The propulsion and maneuvering system of claim 4 wherein the seeker is configured to track the target and maintain the LOS with the target as the target maneuvers, wherein the seeker is further configured to generate command signals for the propulsion system controller, and wherein based on the command signals from the seeker, the propulsion system controller is configured to:

recalculate an intercept point with the target and control the valves to selectively deploying a combination of both the axial thrusters and the divert thrusters to change a burn-out velocity ($V_{bo}$) of the interceptor and cause the interceptor to follow a flight path to the recalculated intercept point.

6. The propulsion and maneuvering system of claim 5 wherein the propulsion system controller is configured to determine when the target is maneuvering based on changes in an angle between the LOS and the flight path of the interceptor.

7. The propulsion and maneuvering system of claim 5 wherein the valves include:

at least one axial thrust control valve coupled to the common propellant distribution manifold and configured for selectively releasing pressurized fuel into combustion chambers of one or more of the axial thrusters for mixing and combustion to provide the axial thrust and to increase a velocity along the LOS; and at least one maneuver control valve coupled to the common propellant distribution manifold and configured for selectively releasing pressurized fuel into combustion chambers of one or more of the divert thrusters for mixing and combustion to provide lateral thrust for maneuvering the interceptor.

8. The propulsion and maneuvering system of claim 7 wherein the propulsion system controller is configured to control at least one maneuver control valve and at least one axial thrust control valve in response to a comparison of a commanded propellant mass flow discharge rate and a calculated actual propellant mass flow discharge rate from the pressure vessel.

9. The propulsion and maneuvering system of claim 8 wherein the controller includes a burn-rate controller configured to calculate a burn rate from a measured pressure within pressurization tanks and to control the valves to adjust the burn rate in response to a comparison between the measured pressure and an estimated pressure based on the recalculated intercept point.

10. The propulsion and maneuvering system of claim 2 wherein when the propulsion and maneuvering system includes two axial thrusters provided at an aft-end of the interceptor and four of the divert thrusters provided at ninety-degree radial positions on the interceptor, and wherein the net sum of the axial thrusters is configured to provide at least twice an amount of thrust of any of the divert thrusters.

11. The propulsion and maneuvering system of claim 1 wherein the interceptor is a liquid-fueled interceptor, and wherein the propulsion and maneuvering system further comprises a fuel tank and an oxidizer tank, and wherein one of the fuel tank and the oxidizer tank has a toroidal shape when provided between the divert thrusters and the axial thrusters of the interceptor.

12. The propulsion and maneuvering system of claim 1 wherein the interceptor is a solid-fueled interceptor.

13. A method for operating a propulsion and maneuvering system for intercepting a target, the method comprising:

providing a control signal from a seeker in response to tracking the target for intercepting the target;

controlling a release of pressurized fuel from a common propellant distribution manifold between axial thrusters and one or more divert thrusters of an interceptor in response to the control signal; and varying amounts of thrust to be provided axially and laterally in response to the release of pressurized fuel.

14. A method for operating a propulsion and maneuvering system for intercepting a target, the method comprising:

providing a control signal from a seeker in response to tracking the target;

controlling a release of pressurized fuel between axial thrusters and one or more divert thrusters of an interceptor in response to the control signal;

varying amounts of thrust to be provided axially and laterally in response to the release of pressurized fuel;

determining when the target is maneuvering; and providing axial thrust to increase a velocity along a line-of-sight (LOS) with the target to reduce target impact time in response to a determination that the target is maneuvering.

15. The method of claim 14 wherein providing axial thrust comprises providing the axial thrust along axial thrust lines that run through a center-of-gravity of the interceptor.

16. The method of claim 15 further comprising:

maintaining the LOS with the target using a seeker; and determining when the target is maneuvering the based on changes in an angle between a LOS to the target and a flight path of the interceptor.

17. The method of claim 16 further comprising configuring a set of valves to control the release of the pressurized fuel from a common propellant distribution manifold to the axial thrusters and one or more divert thrusters in response to control signals from the seeker.

18. An interceptor comprising:

a seeker configured to maintain a line-of-sight (LOS) with a target; and the propulsion and maneuvering system that includes:

one or more axial thrusters to provide thrust along axial thrust lines that run through a center-of-gravity of the interceptor;

a plurality of divert thrusters to provide thrust in radial directions; and a propulsion system controller responsive to control signals from the seeker to regulate a release of pressurized fuel between the axial thrusters and one or more of the divert thrusters to allow varying amounts of thrust to be provided axially and laterally to intercept the target.

19. The interceptor of claim 18 wherein the propulsion system controller is configured to determine when the target is maneuvering and increase an amount of axial thrust to increase velocity along the LOS to reduce target impact time.

20. The interceptor of claim 19 further comprising:

a common propellant distribution manifold for distributing pressurized fuel to both the axial thrusters and the divert thrusters; and a set of valves to control a release of the pressurized fuel from the common propellant distribution manifold in response to control signals from the propulsion system controller.

21. A method for intercepting a target comprising:

identifying when the target is maneuvering to generate control signals based on changes in an angle between a line-of-sight (LOS) to the target and a flight path of an interceptor; and controlling a release of pressurized fuel between axial thrusters and divert thrusters to allow varying amounts of thrust to be provided axially and laterally in response to the control signals.

22. The method of claim 21 further comprising providing axial thrust to increase velocity along the LOS to reduce target impact time.

* * * * *